US007442865B2

(12) United States Patent
Moghaddam

(10) Patent No.: US 7,442,865 B2
(45) Date of Patent: Oct. 28, 2008

(54) INTERCHANGABLE AND MODULAR ACOUSTIC AND ELECTRIC GUITAR APPARATUS

(76) Inventor: Ali Moghaddam, 470 Cypress Ave., Apt. 2, Pasadena, CA (US) 91103

( * ) Notice: Subject to any disclaimer, the term of this patent is extended or adjusted under 35 U.S.C. 154(b) by 100 days.

(21) Appl. No.: 11/009,336

(22) Filed: Dec. 9, 2004

(65) Prior Publication Data

US 2006/0123971 A1 Jun. 15, 2006

(51) Int. Cl.
*G10D 3/00* (2006.01)

(52) U.S. Cl. ..... 84/290; 84/267

(58) Field of Classification Search ..... 84/290, 84/291, 267–289; D17/20
See application file for complete search history.

(56) References Cited

U.S. PATENT DOCUMENTS 3,396,621 A * 8/1968 Dycus ..... 84/293
4,073,211 A 2/1978 Jorgensen
4,111,093 A 9/1978 Field
4,175,468 A 11/1979 Whitlock
4,185,534 A 1/1980 Cove
4,201,108 A 5/1980 Bunker
4,295,404 A 10/1981 Smith
4,377,962 A * 3/1983 Parker ..... 84/269
4,432,267 A 2/1984 Feller
4,433,603 A 2/1984 Siminoff
4,471,682 A 9/1984 Bozung
4,475,434 A 10/1984 Willis
4,491,051 A 1/1985 Barcus
4,539,886 A 9/1985 Hoffart
4,573,391 A 3/1986 White
4,602,547 A 7/1986 Nyack
4,616,550 A 10/1986 Lacroix
4,686,882 A 8/1987 Shaw
4,750,400 A 6/1988 Milne
4,777,858 A 10/1988 Petschulat
4,793,233 A 12/1988 Olthoff
4,854,210 A 8/1989 Palazzolo
4,867,031 A 9/1989 Fender
4,915,003 A 4/1990 Clough
4,915,004 A 4/1990 Clough
4,941,389 A 7/1990 Wendler
5,018,423 A 5/1991 Bunker
5,052,269 A 10/1991 Young, Jr.
5,058,479 A 10/1991 Shaw
5,131,307 A 7/1992 Castillo
5,208,410 A 5/1993 Foley
5,212,329 A 5/1993 Woodworth
5,315,910 A * 5/1994 Soupios ..... 84/453
5,347,905 A 9/1994 Cipriani (Continued)

OTHER PUBLICATIONS

Leeds Guitarmakers' School, "Tips." 6-page printout from http://www.leedsguitar.com/pages/tips.html on Nov. 21, 2004; unknown date of first publication.

(Continued)

*Primary Examiner*—Lincoln Donovan
*Assistant Examiner*—Jianchun Qin
(74) *Attorney, Agent, or Firm*—Law Office of David Hong

(57) ABSTRACT

A musical instrument apparatus has the ability to interchange from acoustic to electric string instrument embodiments; both the acoustic and electric string embodiments share a common hollow modular body assembly.

5 Claims, 16 Drawing Sheets

U.S. PATENT DOCUMENTS

| | | | | |
|---|---|---|---|---|
| 5,353,672 | A | 10/1994 | Stewart | |
| 5,383,385 | A * | 1/1995 | Gilbert | 84/267 |
| 5,398,585 | A | 3/1995 | Starr | |
| 5,408,911 | A | 4/1995 | Weiss | |
| 5,421,233 | A | 6/1995 | Bunker | |
| 5,438,157 | A | 8/1995 | Lace | |
| 5,442,986 | A | 8/1995 | Cota | |
| 5,505,115 | A | 4/1996 | Vandervoort | |
| 5,631,432 | A | 5/1997 | Muncy | |
| 5,637,823 | A | 6/1997 | Dodge | |
| 5,682,003 | A | 10/1997 | Jarowsky | |
| 5,689,074 | A | 11/1997 | Penridge | |
| 5,929,362 | A | 7/1999 | Oteyza | |
| 5,945,614 | A | 8/1999 | White | |
| 5,994,633 | A | 11/1999 | Norton | |
| 6,005,173 | A | 12/1999 | Mitchell | |
| 6,025,548 | A | 2/2000 | Ehrlich | |
| 6,031,165 | A | 2/2000 | Brekke | |
| 6,046,392 | A * | 4/2000 | Saul | 84/291 |
| 6,046,393 | A | 4/2000 | Rose | |
| 6,111,184 | A | 8/2000 | Cloud | |
| 6,120,910 | A | 9/2000 | Szenics | |
| 6,137,039 | A | 10/2000 | Rose | |
| 6,194,644 | B1 | 2/2001 | Hendrickson | |
| 6,198,030 | B1 | 3/2001 | Rose | |
| 6,255,568 | B1 | 7/2001 | Dunwoodie | |
| 6,262,353 | B1 | 7/2001 | Murray | |
| 6,265,648 | B1 | 7/2001 | Steinberger | |
| 6,300,549 | B1 | 10/2001 | Gregory | |
| 6,499,592 | B2 * | 12/2002 | Wilfer | 206/314 |
| 6,525,252 | B1 | 2/2003 | Klausen | |
| 6,653,538 | B1 | 11/2003 | Wells | |
| 6,660,918 | B1 | 12/2003 | Yaskoweak | |
| 6,809,245 | B2 | 10/2004 | Sawhney | |
| 2002/0104423 | A1 | 8/2002 | Verd | |
| 2003/0019349 | A1 | 1/2003 | Green | |
| 2003/0094087 | A1 | 5/2003 | Gregory | |
| 2003/0164080 | A1 | 9/2003 | Childress | |
| 2003/0188622 | A1 | 10/2003 | Wilson | |
| 2005/0132866 | A1 * | 6/2005 | Sawhney et al. | 84/291 |
| 2005/0252363 | A1 * | 11/2005 | Rockett | 84/723 |

OTHER PUBLICATIONS

Guitar Guru, "Guitar Diagrams-Acoustic and Electric." 4-page print-out from http://www.guitars.eu.com/diagrams.htm on Nov. 21, 2004; unknown date of first publication.

Overstock.com, ad for "Acoustic/Electric Guitar Pack." 4-page print-out from www.overstock.com on Sep. 6, 2004; unknown date of first publication.

* cited by examiner

INTERCHANGABLE AND MODULAR ACOUSTIC AND ELECTRIC GUITAR APPARATUS

BACKGROUND OF THE INVENTION

1. Field of the Invention

This invention relates to an apparatus for a modular musical instrument.

2. Description of Related Art

Currently, making string instruments portable faced many problems and disadvantages. In exchange for portability, instruments of the current art altered, reduced, and changed their traditional size and shape. For example, a current portable guitar or bass has a very small body and neck. These portable guitar or bass products do not retain the classic hollow body design and proper neck length. The classic body design of a standard guitar or bass allows for proper acoustic sound, and the proper neck and body length provide an instrument that is familiar and comfortable for the musician to hold and to operate.

However, by eliminating the classic hollow body design and the proper neck length and body size, these portable instruments sacrifice the wonderful sound, which is created by a hollow body design and by a regular acoustic instrument. With very small bodies and necks, the current art instruments produce sounds that are different from regular acoustic instruments.

Further, these portable instruments further reduce their body size or eliminate their body in entirety (i.e., a frame body). However, sacrificing the body dimensions, size, and lengths make these portable instruments difficult for the musician to comfortably hold for performances and recordings, and these portable instruments can change the ergonomics for proper holding and operation of the instrument.

In addition, traditional guitar or bass instruments, which are currently on the market, are very use specific, i.e., acoustic or electric, bass or guitar, and not both. This lack of modularity and flexibility places great strain, logistically and financially, on all musicians. For example, having to pack and to transport several instruments for a performance can be a real challenge to all musicians. From the preceding descriptions, it is apparent that the devices currently being used have significant disadvantages. Thus, important aspects of the technology used in the field of invention remain amenable to useful refinement.

SUMMARY OF THE INVENTION

The purpose of the present invention is to provide the musician/user with an electric and acoustic string instrument (guitar and/or bass) that has a classic hollowed body, which is required for a good acoustic tone for an acoustic guitar and/or bass, and has a satisfactory holding position for an electric and acoustic guitar and/or bass.

Another purpose of the present invention is to provide the musician with a single portable apparatus or unit that is both capable of being an acoustic and electric guitar and/or bass, and at the same time, preserves the traits of a regular acoustic guitar and/or bass and an electric guitar and/or bass. This enables the traveling musician to carry one apparatus or unit instead of several completely, distinct and non-modular instruments.

Another purpose of the present invention is to preserve the shape of a traditional guitar or bass instrument in a portable and modular musical apparatus. Since the body can have a classic hollowed body, this invention provides for many different variations in shapes and sizes, which can produce different tones suitable for different musical styles. For example, the body can be semi-hollow, which is good for jazz and blues music, or hollow with cut-away portions, which are excellent for performing popular and "rock" music. This invention's modular body assembly can be longer and bigger than regular hollowed bodies suitable for acoustic and electric bass. Also, by preserving the classic shape, the instrument aesthetically looks like a regular guitar, and it is familiar to image conscious musicians. This invention's ability to mimic a regular guitar, not only in sound but also appearance is significant in providing a suitable and familiar looking alternative to a regular guitar or bass.

A modular string instrument apparatus comprising: a first string instrument neck assembly; said first string instrument neck assembly having at least one first string instrument neck assembly opening, which passes entirely though the first string instrument neck assembly; at least one first string instrument neck assembly string; at least one first string instrument neck assembly string attachment post, and a first string instrument neck assembly bridge; a second string instrument neck assembly; said second string instrument neck assembly having at least one second string instrument neck assembly string, at least one second string instrument neck assembly string attachment post, an electric string instrument bridge, and at least one electric pickup; a modular body assembly, which is fixedly attached to a sound resonator, said modular body assembly is substantially hollow, and said modular body assembly being able to removably and separately engage the first and the second string instrument neck assemblies, whereby the user can modify the modular music apparatus by interchangeably attaching and removing the first and the second string instrument neck assemblies to the modular body assembly for a particular musical purpose. The first and second string instrument neck assemblies each further comprising at least one tuner; the first string instrument neck further comprises at least one acoustic-type pickup. The modular body apparatus has at least one first modular body surface and at least one second modular body surface; the sound resonator has a first sound resonator end and a second sound resonator end; the first sound resonator end can be fixedly attached to the second modular body surface; and the second sound resonator end is able to detachably engage the first and the second string instrument neck assemblies, respectively. The apparatus can have an additional or third musical instrument, including a non-string type, neck assembly, which can removably engage said modular body assembly. This apparatus can further comprise a case for the first and second string instrument neck assemblies and the modular body assembly.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

DESCRIPTION OF THE PREFERRED EMBODIMENTS

Referring to FIGS. 1-5, there is illustrated an apparatus 10 for a modular and interchangeable musical instrument assembly that allows for two and possibly multiple embodiments (first, second, third neck assemblies, etc.) that share and each individually and separately engage a common modular body assembly. In one preferred embodiment, the invention provides for a modular musical instrument apparatus that can both provide for and allow for being both an acoustic and an electric string instrument, preferably, but not limited to a guitar or a bass; these two acoustic and electric assemblies share a common modular base assembly body. FIG. 18-24 show different embodiments of the invention for string instruments, including but not limited to: acoustic 12-string guitar; electric 12-string guitar with semi-hollow body; acoustic bass; electric guitar with cut-out body; electric bass; acoustic guitar, and classical guitar.

Figure 5:
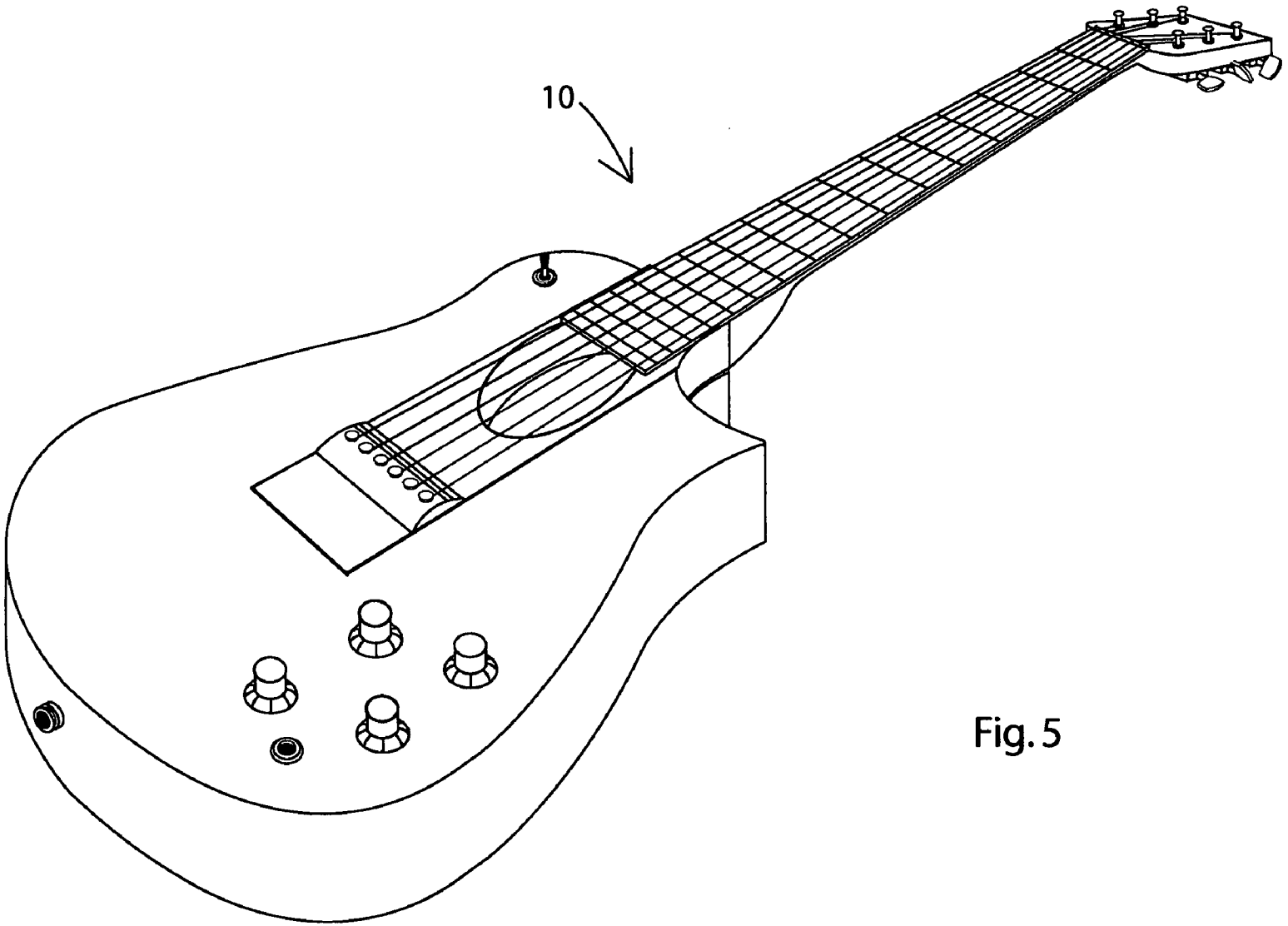
FIG. 5 is a view of one embodiment of the invention, the first or acoustic neck assembly installed into the modular body assembly.
Figure 6:
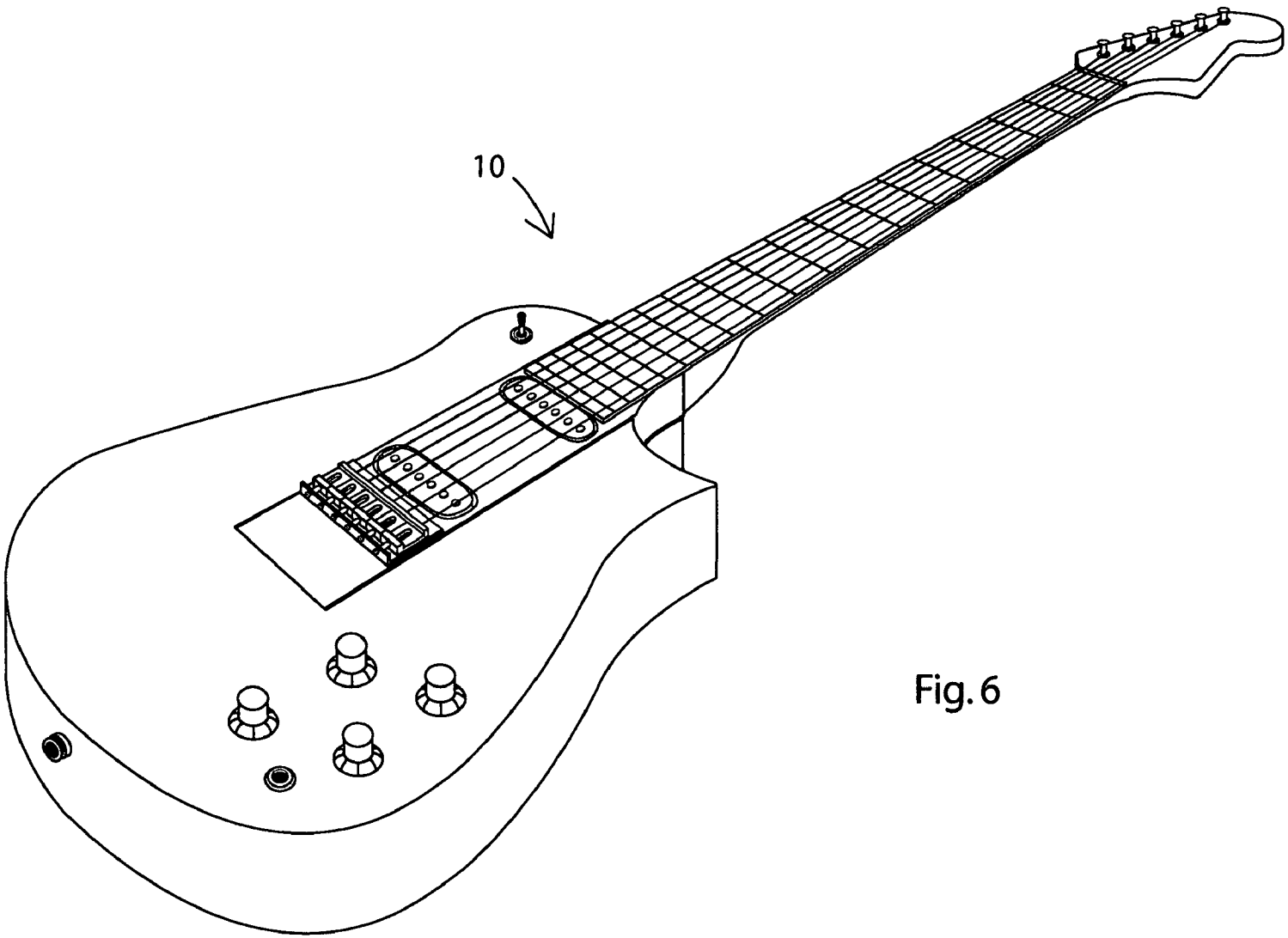
FIG. 6 is a view of one embodiment of the invention, the second or electric neck assembly installed into the modular body assembly.

This music assembly has a first or acoustic neck assembly 15 and a second or electric neck assembly 20; both the first and second neck assemblies can detachably and removably engage, interact, and fit within a common or modular body assembly 25. FIGS. 5 and 6 show some assembled embodiments of the preferred invention. The modular body assembly 25 can be substantially hollow or semi-hollow.

Figure 1:
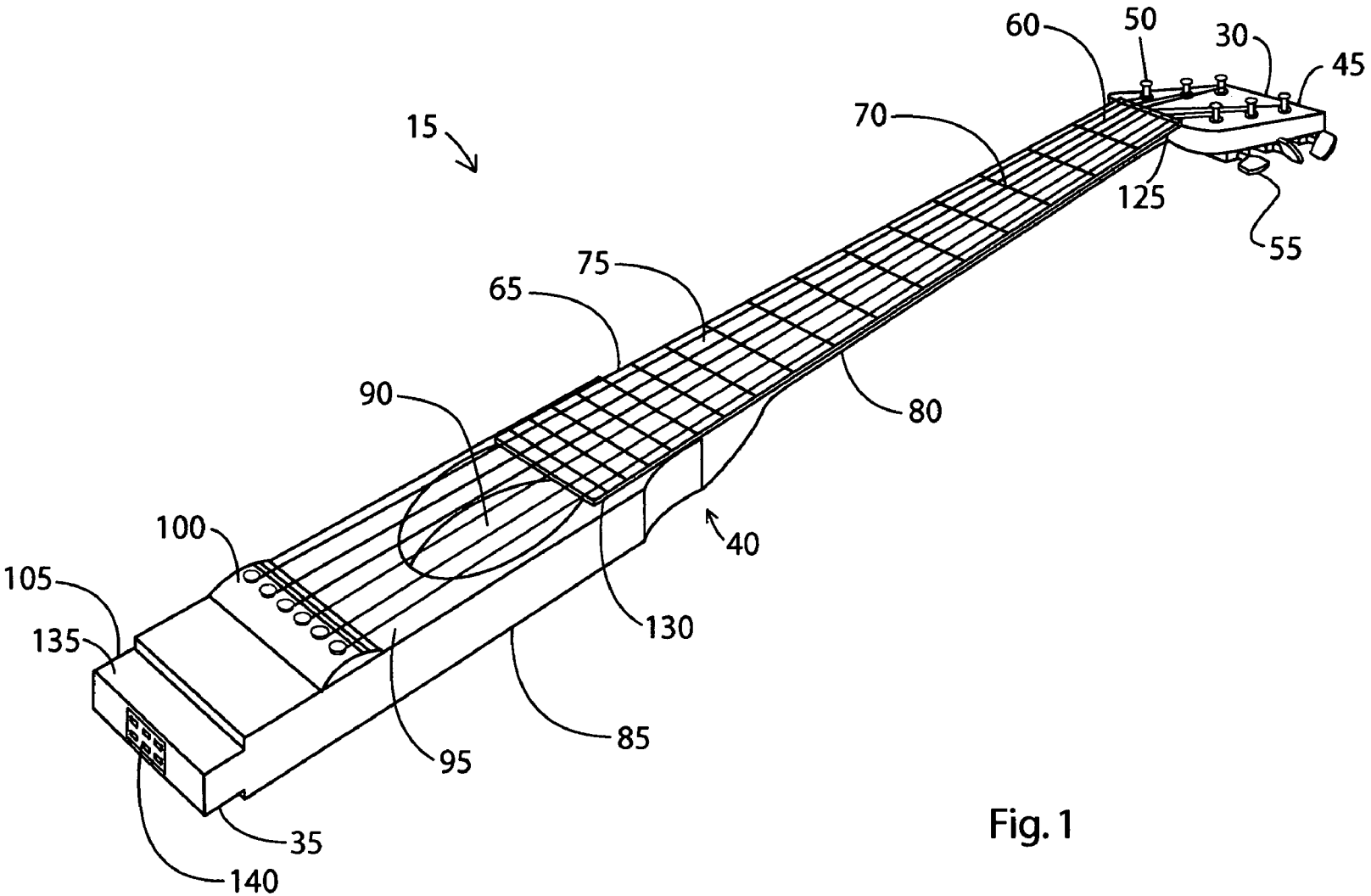
FIG. 1 is a view of one embodiment of the invention, the first or acoustic neck assembly.

Acoustic (First) Neck Assembly (ANA):

Viewing FIG. 1, there is a shown one preferred embodiment of the acoustic or first neck assembly. The first or acoustic neck assembly has a first acoustic neck assembly end 30 and a second acoustic neck assembly end 35 and a middle section 40.

The acoustic neck assembly 15 comprises a head 45 with at least one post 50 and at least one tuning key or tuner 55; at least one string 60; a fret-board or fingerboard 65 with at least one fret 70 and at least one fingerboard surface 75; a neck 80; a neck extension 85 with at least one sound hole or opening 90, which passes completely through the acoustic neck assembly. Because this opening 90 passes through the first neck assembly 15, sounds created from contacting the strings and the vibrations of the body assembly can pass through the modular body assembly 25 and this opening 90 to the outside.

The neck extension 85 has at least one neck extension surface 95; a bridge 100 or acoustic-type bridge is located on the at least one neck extension surface 95 and is attached to one of the ends of the at least one string (the string has a first and second end, then the bridge would be connected to the second end of the string).

The second end 35 of acoustic neck assembly has a lip structure 105, which is an interface or connection area 110 to allow a removable connection to the modular body assembly (specifically, a vibration wing/resonator component of the modular body assembly).

As shown in FIGS. 8 and 11-13, the acoustic neck assembly may also have structures 115, such as holes or receptacles to receive and to engage complementing attachment devices 120 on the modular body assembly 25, including but not limited to a bolt, screw, clamp, clips, hook and loop attachment devices. These attachment devices 120 help hold the first or second neck assembly to the modular body assembly.

Head of the Acoustic Neck Assembly:

Approximately near the first acoustic neck assembly end 30 is a head 45 with at least one post, peg, or string attachment device 50 for mounting and attaching the strings 60 of the instrument. There may also be mounted tuning keys or tuners 55 on the head for adjusting and tuning the string of the instrument. This acoustic neck assembly may have at least one string, and most instruments will require multiple strings. Each string has a first and second string end.

The head or peg-head 45 can also have a paddle or "S" shape on the top of the neck assembly for holding the tuning keys and also to which the strings are attached. The paddle shape is used more often and has more of a classic look, which is used for classical, flamenco, flat-top, 12-string, plectrum, resonator and folk-style guitars. The shape of the peg-head is matter of the preference of the individual musician (i.e. aesthetics, look, style, and ergonomics and comfort to play), and the peg-head shape should not affect the sound tone.

Neck and Fingerboard/Fret-Board of the Acoustic Neck Assembly

Attached to the head or first end of the acoustic neck assembly, there is neck 80 and a fingerboard or fret board 65, which has at least one fingerboard surface 75; this at least one fingerboard surface has at least one fret 70. The fingerboard has a first fingerboard end 125 and a second fingerboard end 130; the second fingerboard end 130 is attached to the neck extension 95, which is another component of the acoustic neck assembly 15. In another possible embodiment, the fingerboard can be removable from and re-attachable to the head and the neck extension.

The neck 80 can be various shapes, lengths, dimensions and sizes, and can mimic traditional guitars. For example, the "S" shaped neck is a newer more modern design and used frequently in more flat-top style guitars.

In one preferred embodiment for this invention, the dimensions of the neck can be similar to a typical acoustic guitar or bass neck, which one can purchase at any music instrument store, and these dimensions vary according to the style of guitar, such as classical, country, folk, and rock. For example, for a classical guitar, the scale length is approximately 25½ to 26¼ inches; the width of the fingerboard at nut is 2.0 to 2³⁄₁₆ inches.

In contrast, a flat-top neck design is relatively more narrow than the classical guitar; this flat-top neck design is more suitable for jazz and blues style playing, and the flat-top designs average approximately 1¾ inches (the width of the fingerboard at the nut).

Further, a 12-string guitar neck has a solid, longer and bigger paddle shaped peg-head for holding twelve strings; it also is longer at the nut, about 1⅞ inch (the width of the fingerboard at nut). The dimensions, figures and measurements listed are merely for example and are not intended to be limiting.

Neck Extension:

Connected to the second end 130 of the fingerboard is the neck extension 85. The neck extension 85 is a critical component of both the first (acoustic) and second (electric) string instrument neck assemblies. In order to allow for the modular and interchangeable aspects of this invention, the neck extension 85 should generally have dimensions (including size, volume, length and width), which are uniform and consistent for both the first (acoustic) neck assembly and the second (electric) neck assembly and any additional neck assemblies.

Please note that the acoustic and electric neck assemblies may have different features to a particular type of neck extension, including but not limited to: the acoustic neck assembly has a sound hole or opening 90, which passes through the neck extension, and the electric neck assembly does not have such a sound hole. This sound hole or opening 90 passes through the neck assembly such that when the neck assembly is engaged to the modular body assembly, there is a passage from the inside of the body assembly, through this opening, to the outside of the instrument.

Overall, the neck extension should be of a relatively uniform dimension so that both the first (acoustic) and second (electric) neck assemblies can fit within the same engagement area of the modular body assembly.

It is also possible in another embodiment for the second or electric neck assembly to have a similar sound hole or opening that passes through the second neck assembly.

In one preferred embodiment of this invention, there is a guitar that has interchangeable neckpieces (acoustic, electric, jazz, rock, etc.) in order to provide the musician with different tones. As a result, the size and dimensions of the neck extension, particularly the area of the neck extension that engages the modular body assembly and the neck extension "part" that goes into the body, is the same size in the acoustic guitar, acoustic bass, electric guitar, electric bass or any other desired neck assembly. The standard size of the neck extension is approximately 3.0 inches in width, approximately 1½ in thickness, and approximately 14¼ in length. Please note that these sizes are merely for example and are not intended to be limiting; different embodiments may have different dimensions.

Sound Hole or Opening:

The first or acoustic neck assembly 15 has an opening, aperture or hole 90 that goes all the way through the acoustic neck assembly and the neck extension. There is normally usually only one opening, but other embodiments may allow for multiple or a plurality of openings. This opening creates a passageway to allow the sounds created from the vibrations of the strings and the modular body to resonate and to escape, which helps create the "classic" acoustic guitar sound. The placement for the sound hole is approximately in the middle of the neck extension, but other embodiments may allow for placement of the sound hole or opening at different locations on the acoustic neck assembly or neck extension.

In one embodiment, the dimensions of the sound hole or opening are approximately five inches in length and 2¼ inches in width, which makes an oval shape. Other possible sound hole shapes can be two smaller circular holes, multiple holes, ovals or other geometric shapes. These dimensions and shapes of the sound hole are only for example and are not intended to be limiting.

Bridge:

The first or acoustic neck assembly 15 also has a bridge 100 or acoustic-type bridge, which is located on a surface 95 of the neck extension and approximately near the second end of the neck extension piece. The exact location of this bridge depends on the particular type of guitar and stringed instrument.

Underneath or approximately near this bridge, there can also be acoustic or acoustic-type pickups that are connected by wires through the acoustic neck assembly to the plug and interface on the second end of the assembly. For example, there can be piezo pickups, but other types of pickups can also be employed by this invention, including but not limited to mini-microphone style pickups that are installed near or inside the body of the instrument. These pickups allow the user to hook up the acoustic neck assembly through the modular body (from the pickup to the plug on the acoustic neck assembly second end, to the interface on the vibration wing interface, and finally to an acoustic output jack) to a recording device or amplifier. The acoustic neck assembly can also operate effectively as a guitar and play music alone without such a pickup, wires, and amplifiers.

Lip and Interface with the Modular Body Assembly:

As shown in FIG. 1, located at the second end of the acoustic neck assembly, there is a lip 105, which engages the modular body assembly. This lip 105 may have at least one lip engagement surface 135, and other embodiments may allow for multiple lip engagement surfaces and elevations. The lip 105 is located at the second end of the neck extension, approximately in the middle of the end wall. The lip should mimic or be similar in width to the neck extension or approximately three inches; the thickness of the lip is approximately /3;4 inches, and the length of the lip is about one inch. These dimensions are for example only and are not intended to be limiting.

The lip has two major functions: (1) to help keep the acoustic neckpiece in the body; and (2) to help transfer the acoustic pickup receiving through a female connector plug or interface, which is located approximately in the middle of the lip. This female connector plug or interface 140 on the lip will engage and connect the male plug connector 520 in the body, specifically the second end of the vibration wing. Please note that this engagement device on the lip of the neck extension and the engagement or interface device on the modular body assembly can be interchanged (male piece on the lip and the female piece on the modular body); also additional interface devices can be used, including but not limited to plugs, sockets, and male/female interlocking pieces.

FIG. 5 shows the acoustic neck assembly engaged and placed within the engagement area of the modular body assembly.

Materials:

The acoustic neck assembly and components can be comprised of various materials, preferably but not limited to wood, wood fiber composites, carbon fibers, or plastics.

Figure 2:
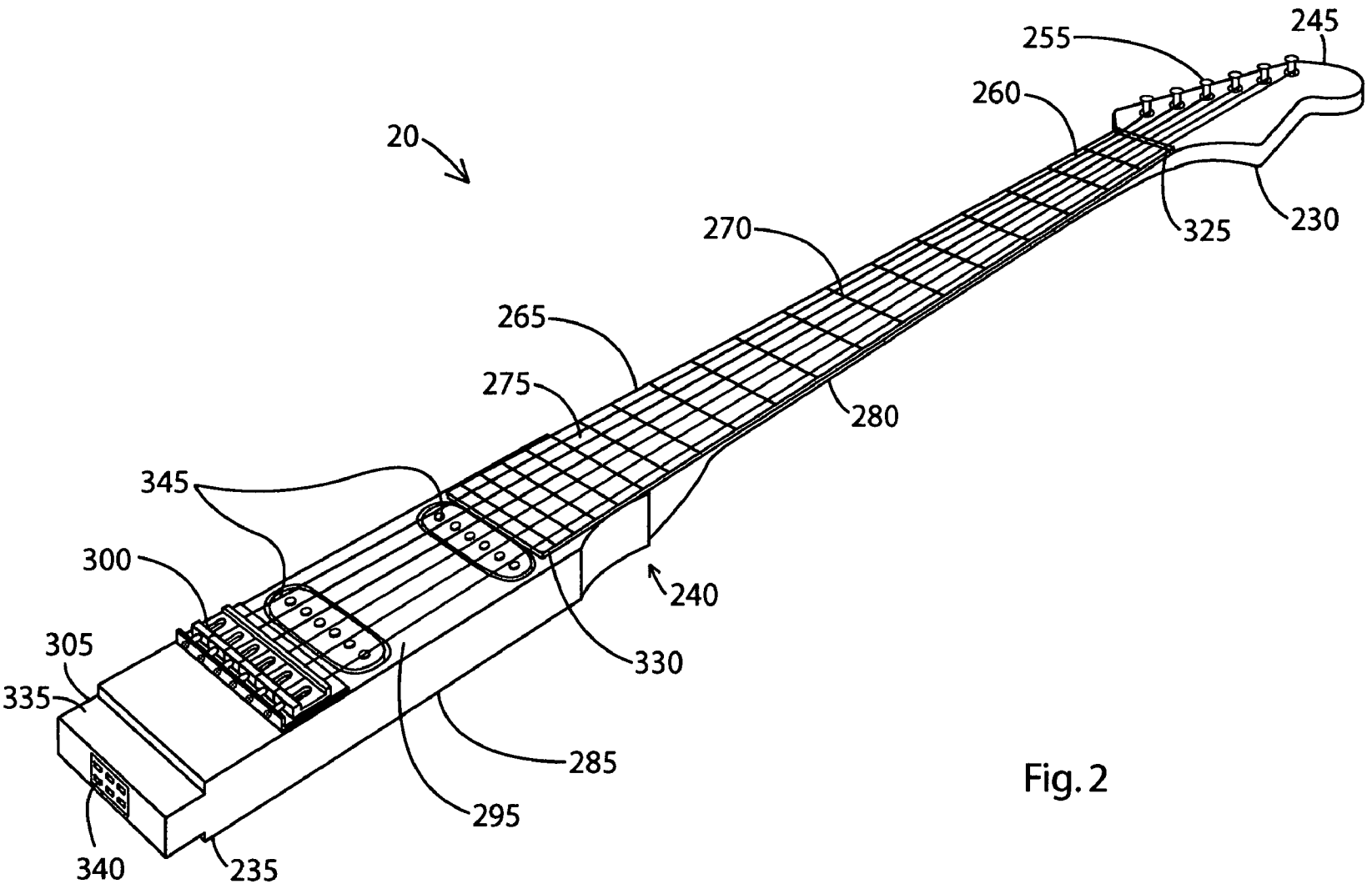
FIG. 2 is a view of one embodiment of the invention, the second or electric neck assembly.

Electric or Second Neck Assembly (ENA):

As shown in FIG. 2, there is shown the electric neck assembly 20, which has a first electric neck end 230 and second electric neck assembly end 235 and a middle section 240. The electric neck assembly comprises a head 245 with at least one post 250 and at least one tuning key/tuner 255; a fret-board or fingerboard 265 with at least one fret and at least one fingerboard surface 275; at least one string 260 (said strings having a first and second string end); a neck 280; a neck extension 285 without a sound hole (the preferred embodiment of the second or electric neck assembly does not have a sound hole, but for other embodiments, an electric neck assembly can have at least one sound hole(s) or opening(s)); the neck extension 285 has at least one neck extension surface 295; an electric bridge 300 is located on the at least one electric neck extension surface 295 and is attached to one of the ends of the at least one string; the second end 235 of electric neck assembly has a lip structure 305 and an interface or connection area 310 to allow a removable connection to the modular body assembly (specifically, a vibration wing/resonator component of the modular body assembly); the electric neck assembly may also receive and engage attachment devices 120 to help fasten this second neck assembly to the modular body assembly. These attachments 120 should be able to fit both the first and second neck assemblies in the same fashion and manner.

Head of the Electric Neck Assembly:

The second or electric neck assembly has a first electric neck assembly end 230 and a second electric neck assembly end 235. Approximately near the first electric neck assembly end 230 is a head 245 with at least one post 250, peg, or string attachment device for mounting and attaching the strings 260 of the instrument. There may also be mounted tuning keys 255 on the head for adjusting and tuning the strings of the instrument. This electric neck assembly may have at least one string, and most instruments will require multiple strings. Each string has a first and second string end.

Electric tuning keys 255 are located and attached to the head or peg-head. The shape of head can be "S" shaped or paddle shaped or any kind of shape. Similar to the head of the acoustic neck assembly as described above, the shape of the peg-head or head of the electric neck assembly is matter of preference and should not affect the sound tone.

Neck and Finger or Fret-Board of the Electric Neck Assembly

Attached to the head 245 or first end 230 of the electric or second neck assembly, there is neck 280 and a fingerboard or fret board 265, which has at least one fingerboard surface 265; this at least one fingerboard surface has at least one fret 270. The fingerboard 265 has a first 325 and a second 330 fingerboard end; the second fingerboard end 330 is attached to an electric neck extension 285, which is another component of the electric neck assembly. In another possible embodiment, the fingerboard can be removable from and re-attachable to the head and the neck extension. The neck can be various shapes, lengths, dimensions and sizes, and can mimic traditional guitars.

Neck Extension for the Electric Neck Assembly:

Connected to the second end 330 of the fingerboard of the second or electric neck assembly is the second or electric neck extension 285. As noted above, the neck extension dimensions are important features for the ability of both the acoustic and electric neck assemblies to interact and to engage the modular body assembly, separately. In order to allow for the modular and interchangeable aspects of one preferred embodiment of this invention, the neck extension should generally have a dimension (including size, volume, length and width) uniform and consistent for both the first (acoustic) neck assembly and the second (electric) neck assembly and any additional neck assemblies.

As noted above, one preferred embodiment of the second or electric neck assembly does not have a sound hole, but overall, the neck extension should be of a relatively uniform dimension so that both the acoustic and electric neck assemblies can fit within the same engagement area of the modular body assembly.

In one preferred embodiment of this invention, there is a guitar that has interchangeable neck assemblies (acoustic, electric, jazz, rock, etc.) in order to provide the musician with different tones. As a result, the size and dimensions of the neck extension, particularly the area of the neck extension that engages the modular body assembly and the neck extension "part" that goes into the body, is the same size in the acoustic guitar, acoustic bass, electric guitar, electric bass or any other desired neck assembly.

Similar to the acoustic neck assembly as described above, the dimensions of the electric neck assembly of this invention can mimic and be similar to an "off the shelf" electric guitar and bass; the size and dimension of the neck can vary according to the style of the guitar. Because of the modular and interchangeable features of this invention, different types, styles, and kinds of electric guitar necks can be used, incorporated, and adapted in this invention for the electric neck assembly.

Electric Pickups and Electric Bridge:

Located on the neck extension 285 of the electric or second neck assembly are at least one electric pickup 345 and an electric bridge 300. The bridge or electric bridge 300 is located on a surface of the neck extension and approximately near the second end of the neck extension piece. The exact location of this bridge depends on the particular type of guitar and stringed instrument.

There can be at least one electric pickup 345 or a plurality of pickups, including but not limited to two, three, or four pickups. This invention allows for different types of pickups, including but not limited to single coil and dual coil (humbucking) types.

The pickup configuration depends on the style of music for which the instrument is built and designed. For example, different type and same-type pickups can be used to produce desired and particular tones. The mountings for the pickups are designed to allow the pickups to be replaceable, which in turn allows for multiple pickup arrangement and use.

Lip and Interface with the Modular Body Assembly:

As shown in FIG. 2, located at the second end of the electric neck assembly, there is a lip structure 305, which engages the modular body assembly and is similar to the lip structure on the first neck assembly. This lip 305 may have at least one lip engagement surface 335, and other embodiments may allow for multiple lip engagement surfaces and elevations. The lip is located at the second end of the neck extension and the second end 235 of the neck assembly and approximately in the middle of the end wall. The lip 305 should mimic or be similar in width to the neck extension or approximately three inches; the thickness of the lip is approximately ¾ inches, and the length of the lip is about one inch. These dimensions are for example only and are not intended to be limiting.

The lip has two major functions: (1) to help keep the acoustic neckpiece in the body; and (2) to help transfer the electric pickup receiving signals and information through a female connector plug or interface 340, which is located approximately in the middle of the lip. This female connector plug or interface on the lip will engage and connect the corresponding male plug connector in the body assembly. Please note that this engagement device on the lip of the neck extension and the engagement or interface device on the modular body assembly can be interchanged (male piece on the lip and the female piece on the modular body); also additional interface devices can be used, including but not limited to plugs, sockets, and male/female interlocking pieces.

FIG. 6 shows the electric neck assembly engaged and placed within the engagement area of the modular body assembly.

Materials:

The electric neck assembly and components can be comprised of various materials, preferably but not limited to wood, wood fiber composites, carbon fibers, plastics, or alloys.

Modular Body Assembly (MBA):

As shown in FIGS. 4 and 7-10, there is a modular body assembly 25 (MBA), which is designed to receive multiple neck assemblies, including but not limited to a first (acoustic) neck assembly and a second (electric) neck assembly and different kinds of necks (electric, acoustic, bass, guitar, and other string and non-string musical instruments).

The body assembly has a first 400 and second 405 modular body assembly end; the second modular body assembly end 405 has an opening or engagement area 410 where either the first (acoustic) or second (electric) neck assembly parts are inserted.

The body assembly has at least one modular body assembly surface 415, and the body can have a first or outer body surface 420 and a second or inner body surface 425. Located on various locations of the outer surface of the body, there can be electric tone controls, electric tone switches, electric output jack 495 and/or acoustic output jack 445 to connect to an external amplifier or effects device (see FIG. 5-7).

Figure 3:
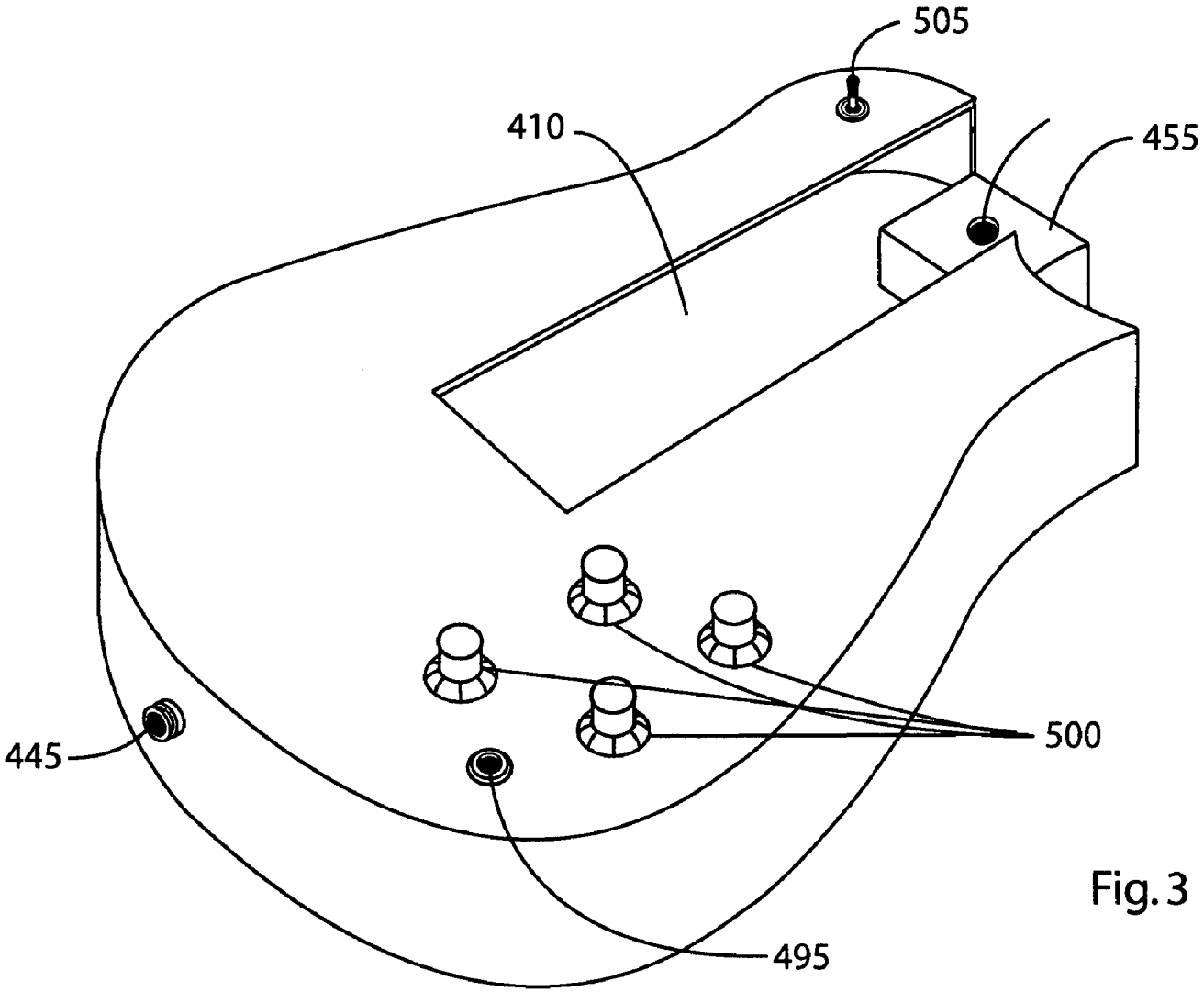
FIG. 3 is a view of one embodiment of the invention, the modular body assembly.
Figure 4:
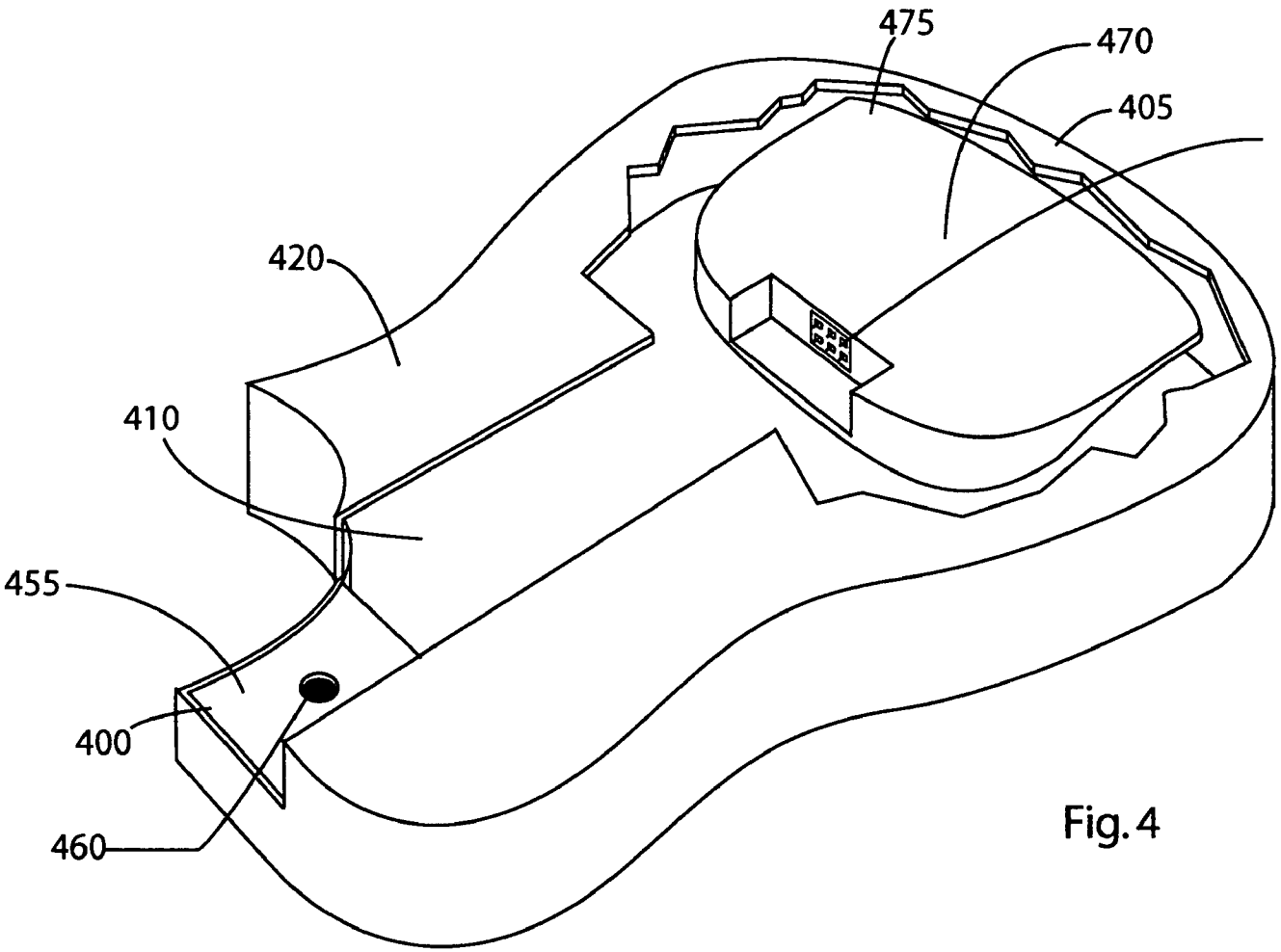
FIG. 4 is another view of one embodiment of the invention, the modular body assembly; the modular body assembly has been exposed to reveal the vibration wing.
Figure 7:
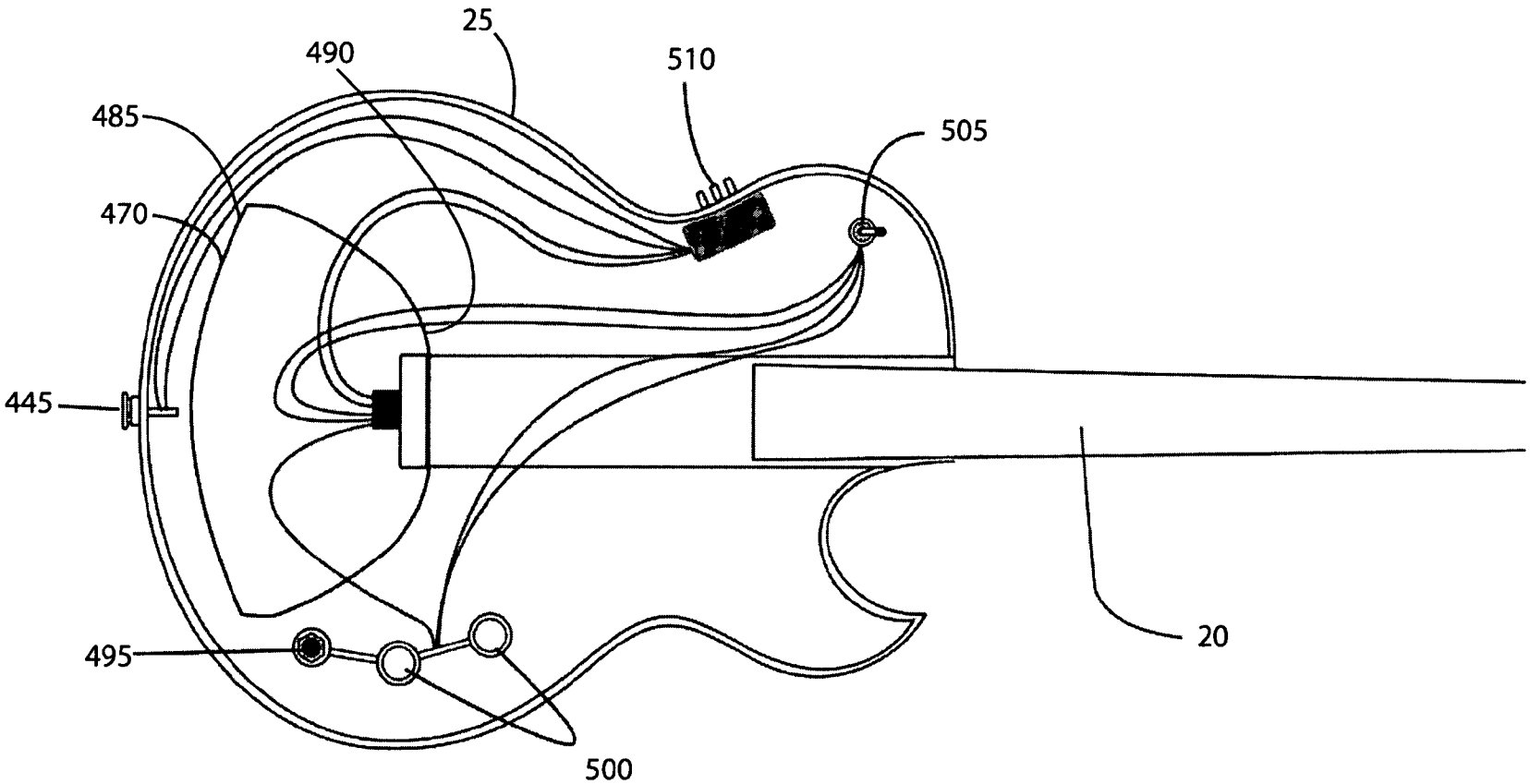
FIG. 7 is an overhead view of the internal structures of the modular body assembly with either the acoustic or electric neck assembly.

The first or outer surface of the body can have more than one surface, including but not limited to a first outer body surface (top or playing side) 430, second outer body surface (sides) 435, and third outer body surface (back of body) 440; an acoustic output jack 445 can be placed near the second end 425 of the body and on the second outer surface 435 of the body; the electric output jack can be placed approximately near the second end of the body and on the first outer surface of the body; the placement of the output jacks or electric volume 500, electric tone 505, acoustic tone and volume 510 controls or switches or any other sound or tone controls should not be limiting and can be placed in different locations on the body; further, volume and tone control knobs can be placed on the second outer surface of the body as shown in FIGS. 3 and 7. Accordingly, there will also be corresponding wiring within the body for these knobs, dials, jacks, and control and volume attenuating devices (see FIG. 7).

The body assembly can be substantially hollow or semi-hollow; the body assembly may also allow for having openings 450 or holes 450 that penetrate the at least one modular body surface. For example, a semi-hollow body has a relatively similar thickness as an electric guitar body, but this semi-hollow body does have space within the body cavity.

Neck Extension Engagement Area of the Modular Body Assembly

As shown in FIG. 3, the body assembly has an opening 410 on the outer surface of the body. This opening 410 of outer surface of the body assembly is a neck extension engagement area; this opening 410 should mimic the width, size, shape, and relative length of the neck extension to receive, engage, and interact with the neck extension of the first or second neck assembly parts. In order to create a good outward appearance, the neck and body assemblies should fit, engage, and interact neatly and snugly together.

The shape of the body may be the "cut-away" style of guitar; this style has part of the body (near the first end of the body) is severed and deleted such that one side of the guitar does not mirror the other side of the guitar (the two sides facing the neck of the guitar). This "cut-away" style is commonly found on current guitars.

The body has a slot or opening 410 to allow the first or second neck assembly to be inserted into the cavity of the body assembly. The size, shape, and dimensions should mimic the corresponding first or second or third or fourth neck assembly pieces so that there will be a tight and uniform fit.

Neck Holding Device:

This neck extension engagement area can also have a neck holding block 455 or structures to further help the neck assembly piece engage the body. The neck holding block can accept and receive connection devices 120, which can be clips, screws, nuts and bolts, levers, male/female engagement parts, hook/loop fasteners, and quick release clips. For example, a bolt 120 can enter a bolt or screw hole 460 in the neck holding block and be passed through the neck holding block 455 and attach the corresponding neck assembly, after the neck assembly has been inserted into the neck extension engagement area or simply body opening.

Figure 13:
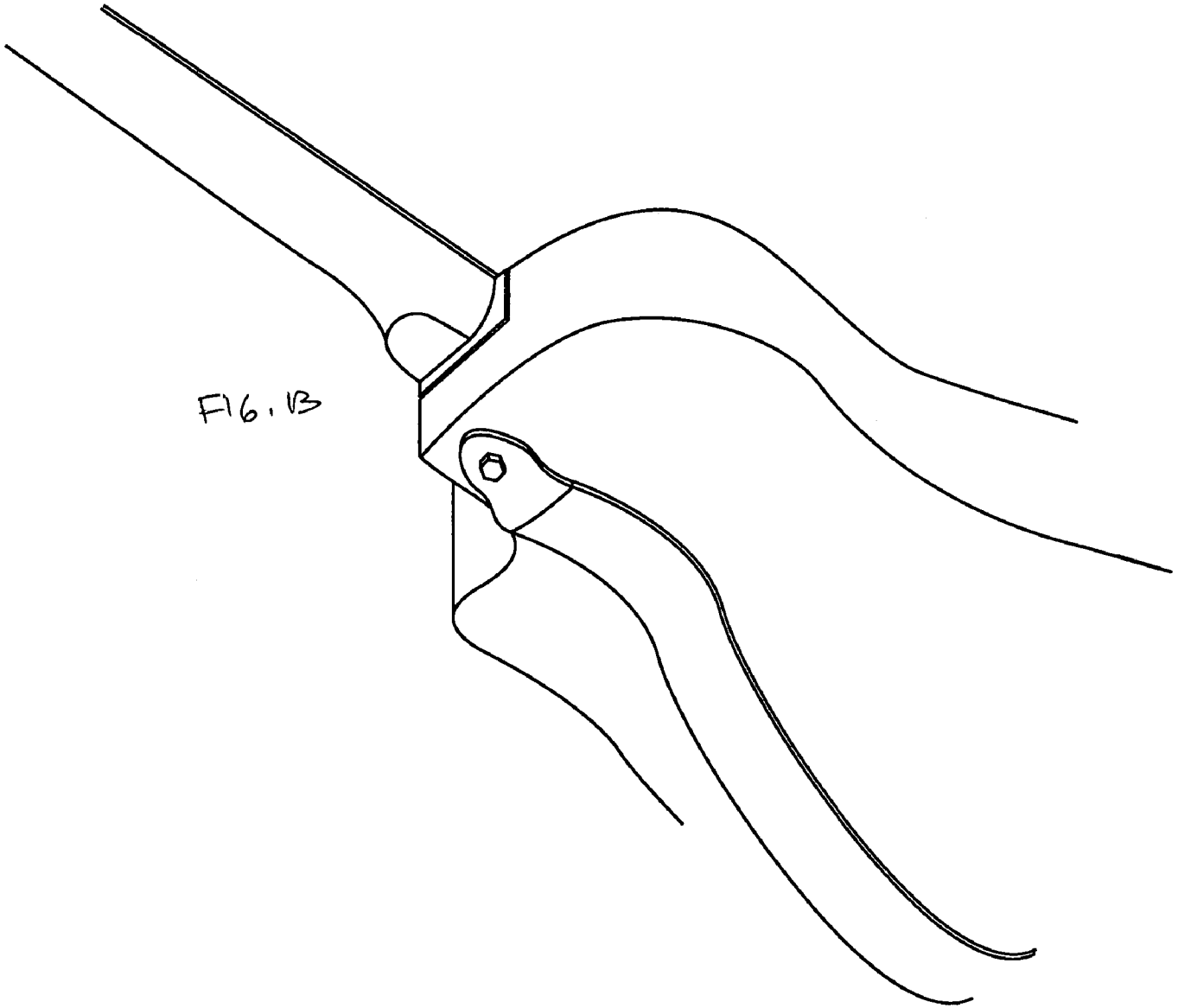
FIG. 13 shows a guitar strap accessory attached to the attachment device on the modular body assembly.
Figure 14:
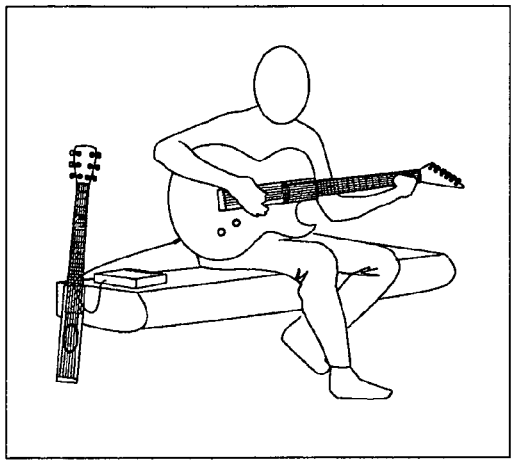
FIG. 14 shows a musician playing one embodiment of the second or electric neck assembly with the invention.
Figure 15:
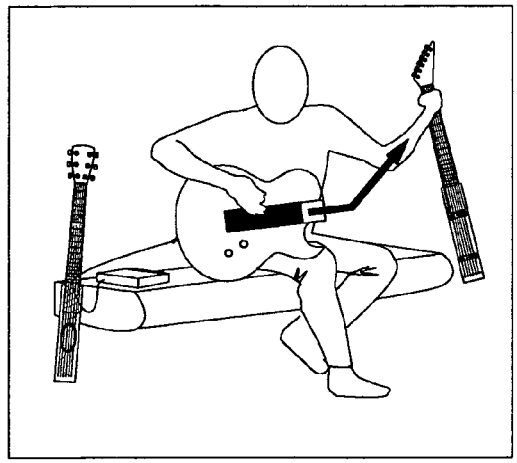
FIG. 15 shows the shows the musician removing or sliding out of the second or electric neck assembly from the modular body assembly.
Figure 16:
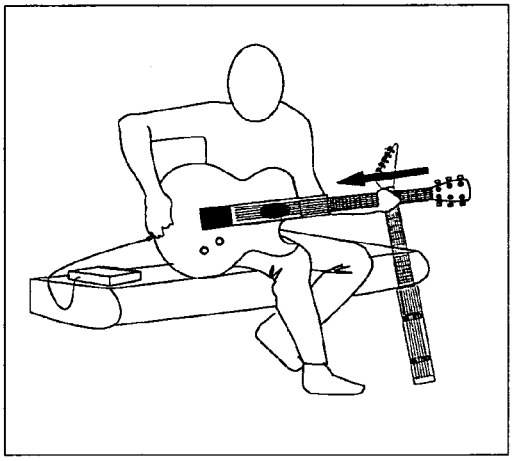
FIG. 16 shows the shows the musician installing and sliding in the first or acoustic neck assembly into the modular body assembly.
Figure 17:
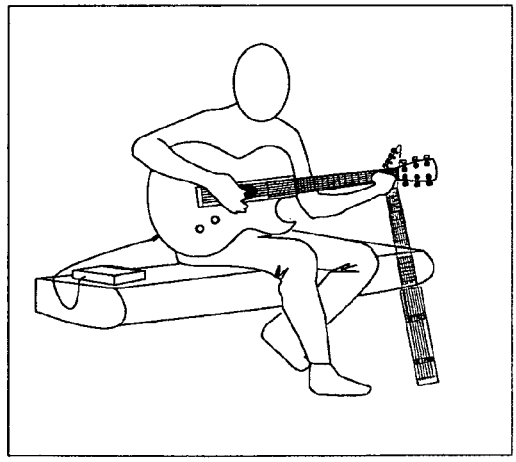
FIG. 17 shows the musician playing one embodiment of the first or acoustic neck assembly with the invention.
Figures 18, 19, 20, 21, 22, 23, 24:
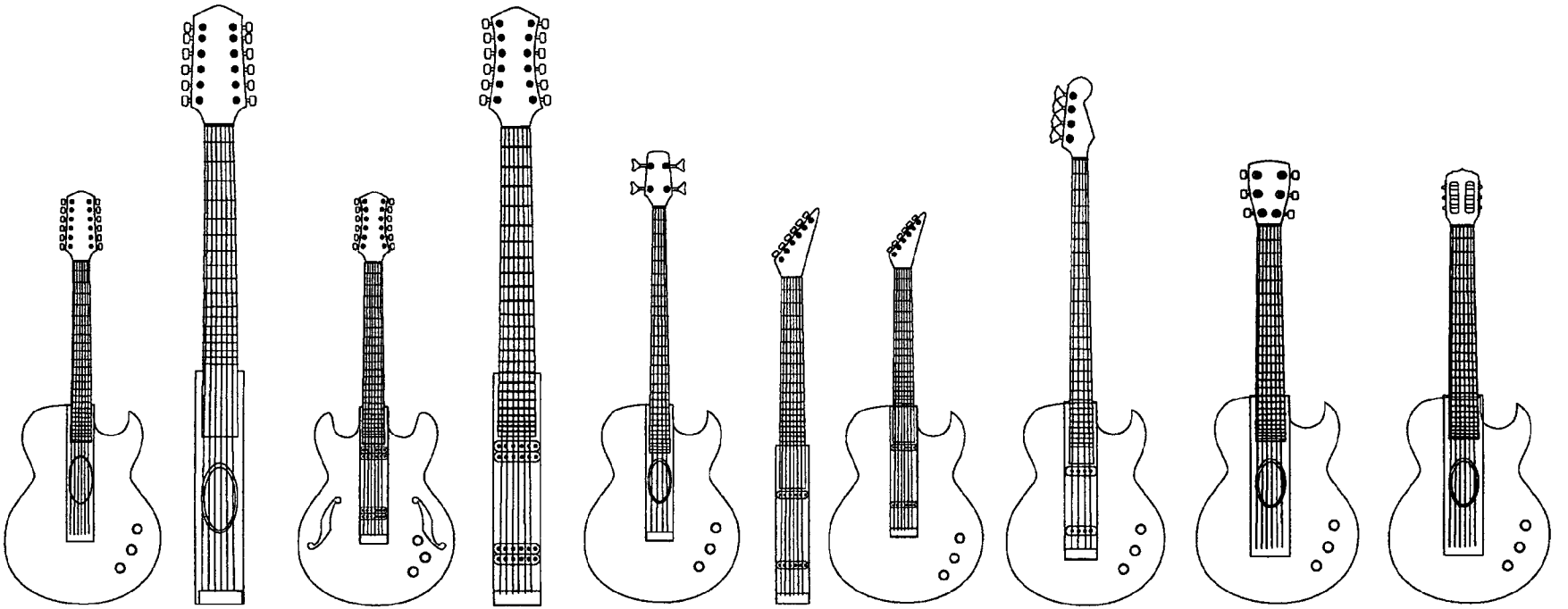
FIG. 18-24 show different combination of embodiments of string musical instruments for the invention; strings are shown in these embodiments.
Figure 25:
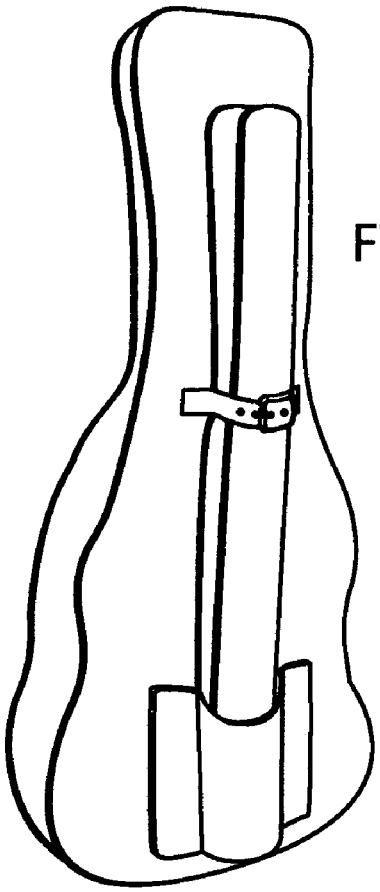
FIG. 25 shows one example of a soft sided case for the invention.
Figure 26:
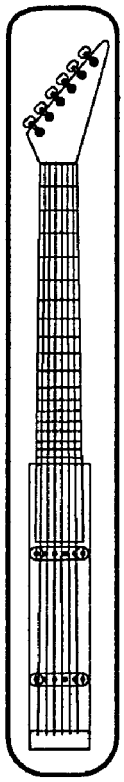
FIG. 26 shows one example of how the first or acoustic neck accessory can be stored in the outer pocket of the soft-sided case.
Figure 27:
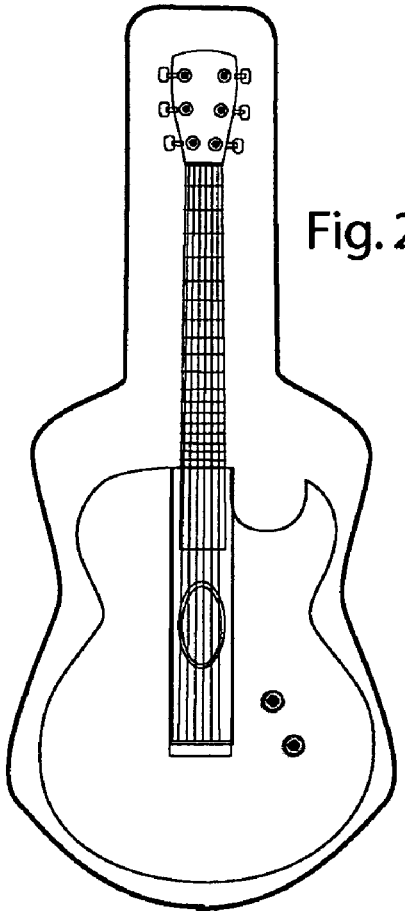
FIG. 27 shows one example of how the modular body and second or electric neck assemblies can be carried and stored in the main cavity of the soft-sided case.
Figure 28:
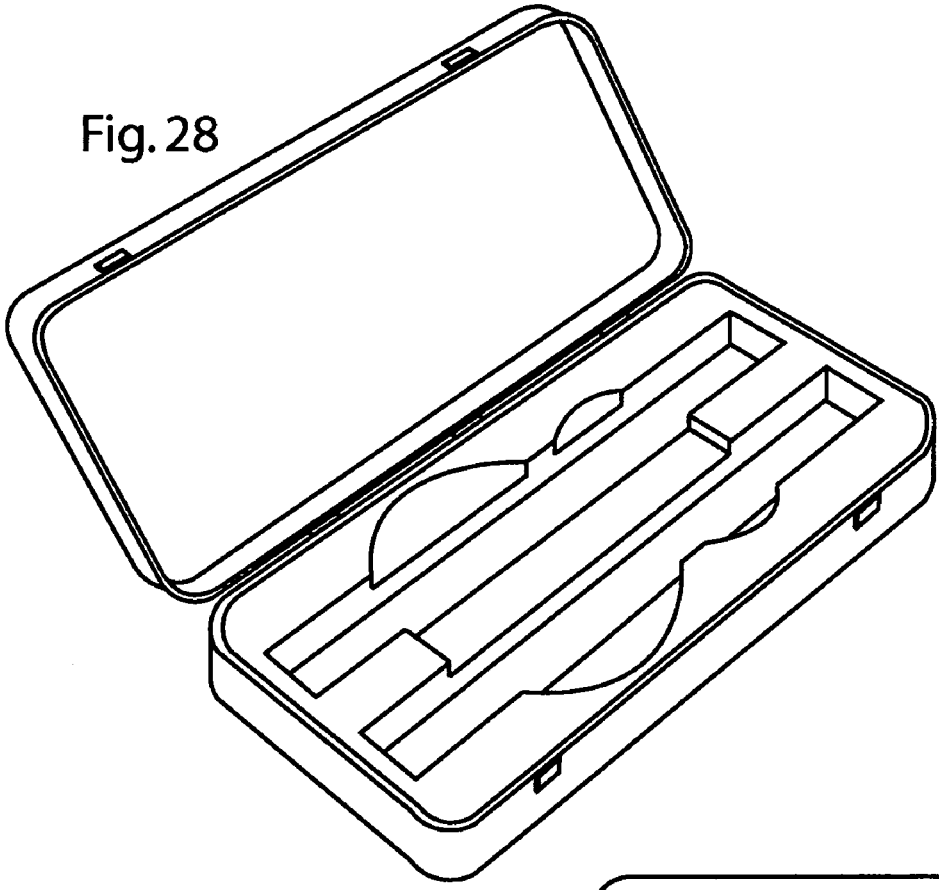
FIG. 28 shows one example of a hard sided case for the invention.
Figure 29:
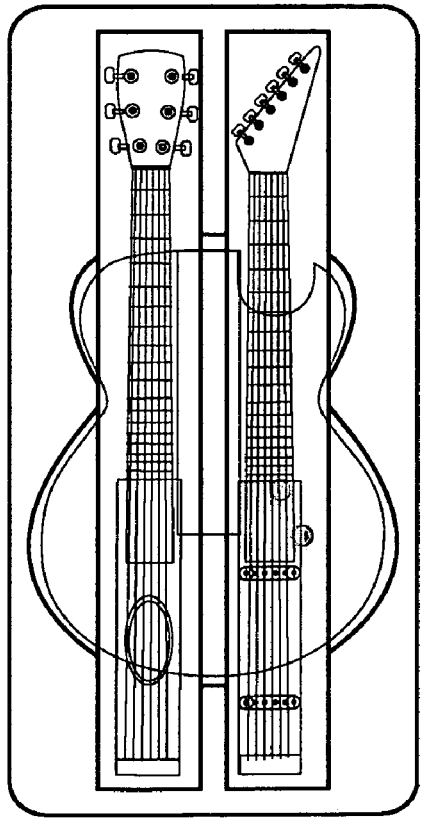
FIG. 29 show how the first and second neck assemblies and the modular body assembly can be easily carried in one hard-sided case.

As shown in FIG. 13, the bolt or attachment device may also be a source of attachment for a strap for carrying, holding, or wearing the instrument assembly on the musician or user. The strap may attach on extra material on the bolt or screw attachment device.

Vibration Wing or Resonator of the Modular Body Assembly

Viewing FIG. 4, 7-10, there is a body interface structure, vibration resonator or "vibration wing" 470 that serves several purposes. For the first or acoustic neck assembly, this vibration wing or resonator 470 is the part of the body assembly that receives and interacts with the second end of the acoustic neck assembly, including the plug or acoustic interface connector 340. This vibration resonator 470 also helps transfer the vibration and sound energy from the at least one string to the top or first outer surface of the body; this vibration wing helps in creating the "classic" acoustic sound to this invention. The vibration wing 470 transfers energy and vibrations from the user's movements to the strings, which are transmitted to the bridge and then to the top surface of the guitar body. Since the neck assembly also forms a part of the top of the body assembly and can also be physically separated from the body assembly, this sound resonator or vibration wing helps to provide continuity to allow proper transfer of sound energy and vibrations from the neck assembly to the top surface of the guitar body. Thus, the top surface of the guitar body is able to resonate and to create sound; please note sounds also are created and expelled through the sound hole on the neck assembly.

The vibration resonator/wing has first 485 and second 490 vibration resonator ends; the first vibration resonator end 485 is fixedly attached to the second modular body surface 425 (the inside of the body and preferably adjacent to the top surface of the body). The second vibration resonator end 490 allows for detachable and re-attachable engagement and interaction with the second end or lip of the first and second neck assemblies and the neck extensions.

In addition, if the acoustic neck assembly has acoustic pickup devices mounted, the vibration wing further serves as a conduit to transfer the sound frequencies, vibration and energies from the pickup in the neck to the body and to the acoustic pickup hardware and wires, which are installed in the interior of the body.

For the electric neck assembly, the vibration wing or body interface structure helps secure and attach the second end of the electric neck assembly to the body; this vibration wing also helps transfer the sound frequencies and energy from the electric pickups, which are mounted in the electric neck assembly, to the body, and then through the wires to the electric output jack for recording or for amplification.

First Vibration Wing End

As shown in FIG. 7-10, the vibration wing has first vibration resonator end 485 and a second vibration resonator end 490; the first vibration resonator end 485 substantially contacts the inner modular body surface 425 so that good transfer of the string vibration energy can occur. The second vibration resonator end 490 removably engages, integrates, and contacts the neck assembly interface of the second end of the neck assembly. The first vibration resonator end can be emphasized to have a large surface area affixed and in contact with the inner surface of the modular body (first inner surface).

Second Vibration Wing End

The vibration wing or resonator 470 has a second vibration wing/resonator end, which is the part of the body that actually meets, interlocks, engages, and receives the corresponding interface on the second end of the neck assembly (i.e., acoustic or electric neck assemblies). Because this invention employs plugs, joints, universal, or male/female connectors to connect the second end of the acoustic/electric assembly, the user/musician can easily attach the neck assembly and lip into the interface/connection area of the vibration wing. This engagement of the neck assembly's second end into the neck assembly interface of the vibration wing is a male/female coupling and engagement. Other embodiments can have the neck assembly second end as the female piece and the vibration wing as the male piece. This invention can also employ other interface connections.

Figure 8:
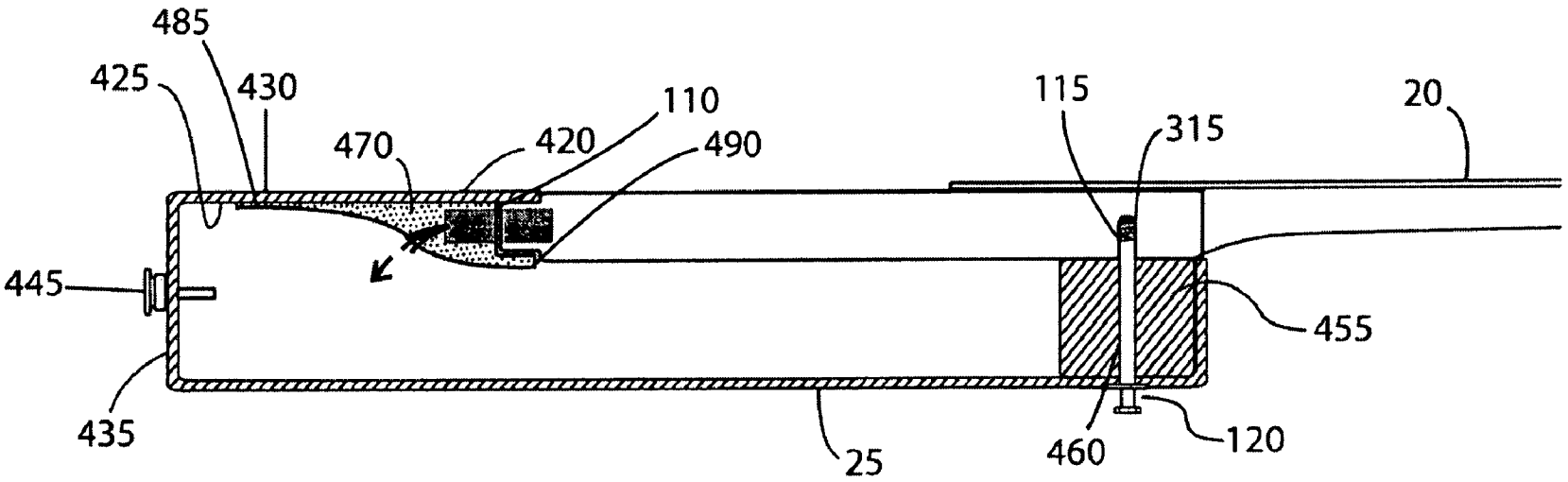
FIG. 8 is a cross-sectional view of the internal structures of the modular body assembly with either the acoustic or electric neck assembly.
Figure 9:
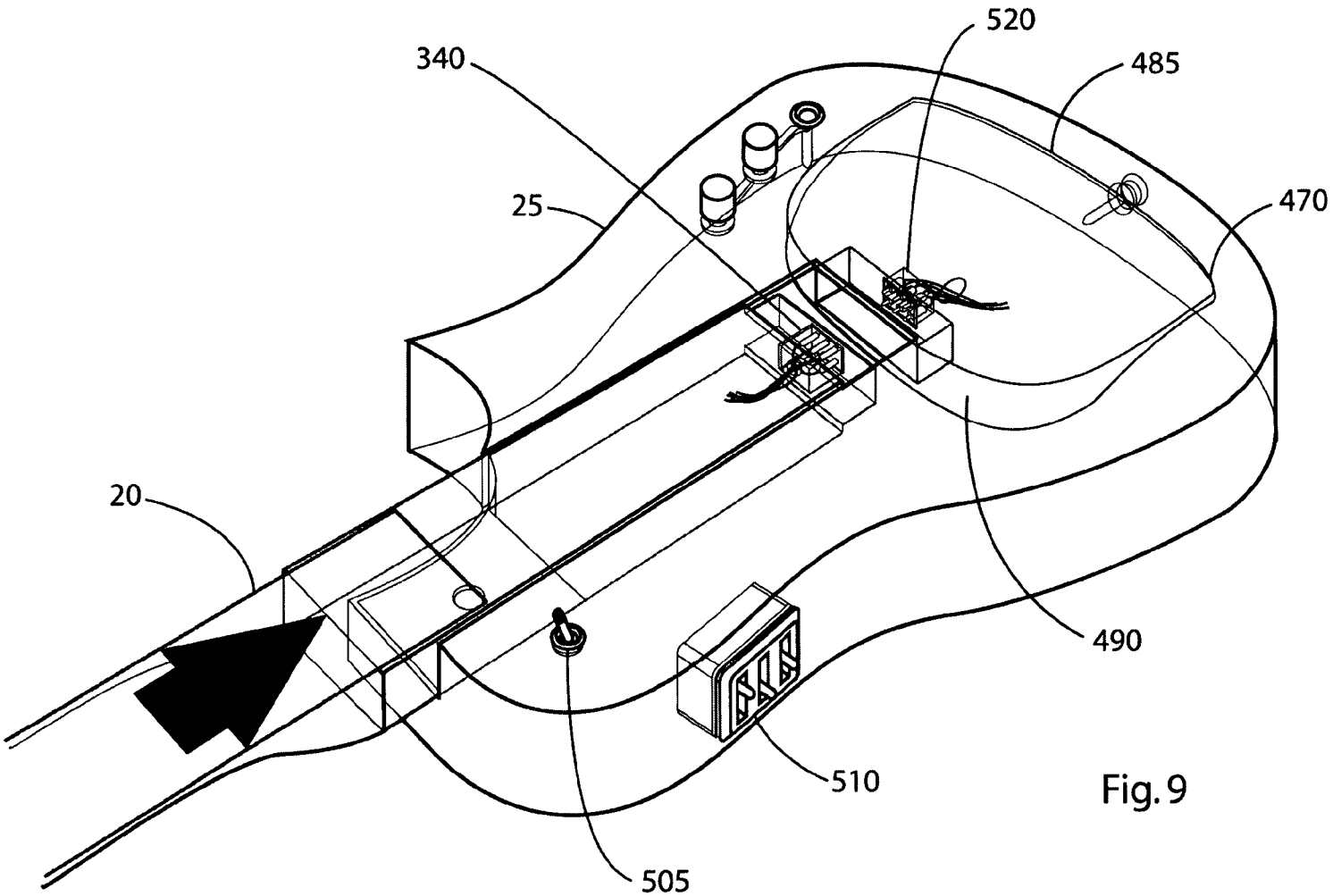
FIG. 9 is another view of one embodiment of the invention, namely the internal structures of the modular body assembly.
Figure 10:
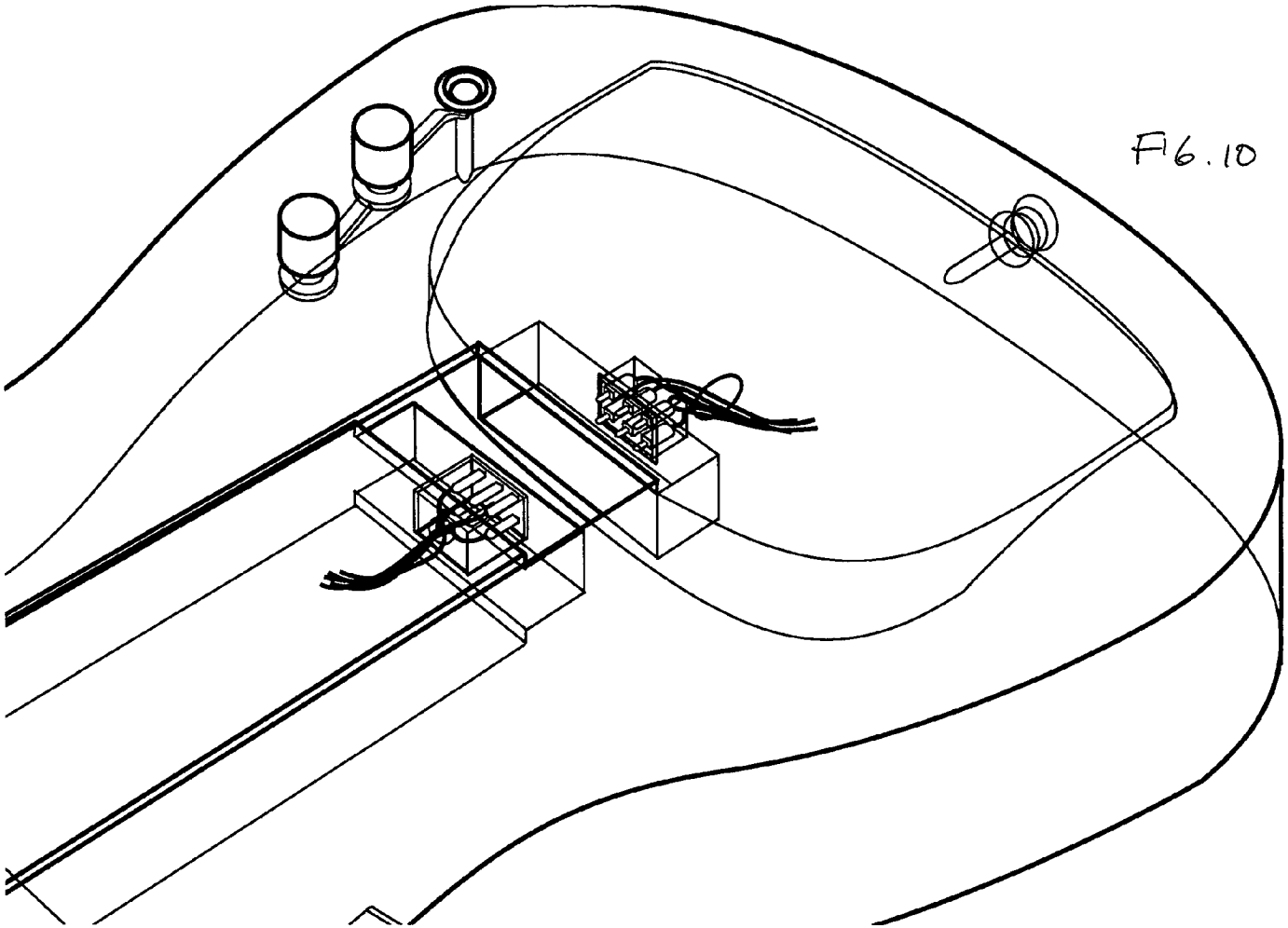
FIG. 10 is another view of one embodiment of the invention, namely a close-up view of the internal structures of the modular body assembly.
Figure 12:
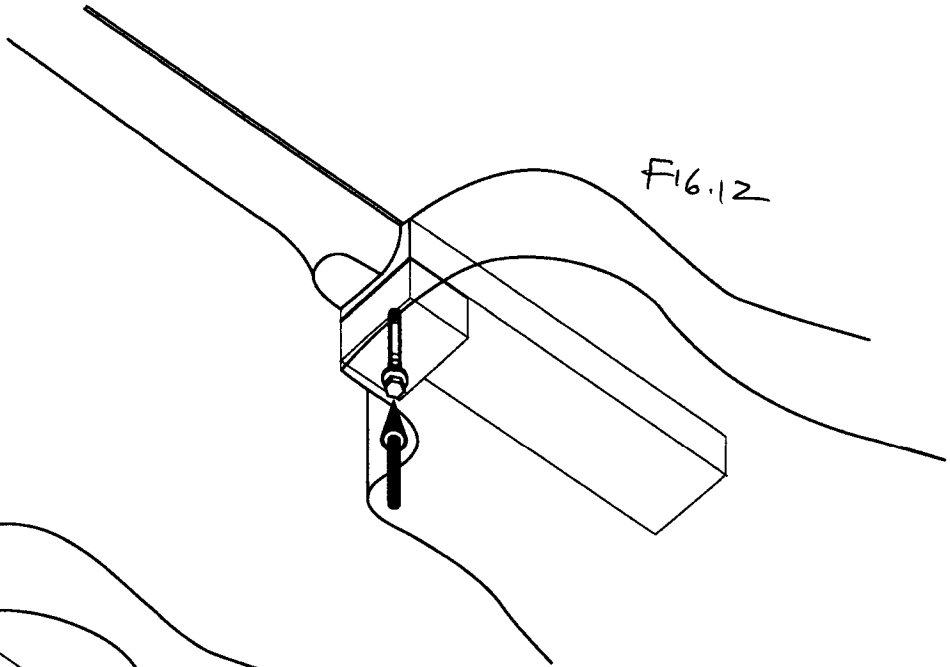
FIG. 11 and FIG. 12 show the attachment device, here a bolt, being used to secure the neck assembly to the modular body assembly.
Figure 11:
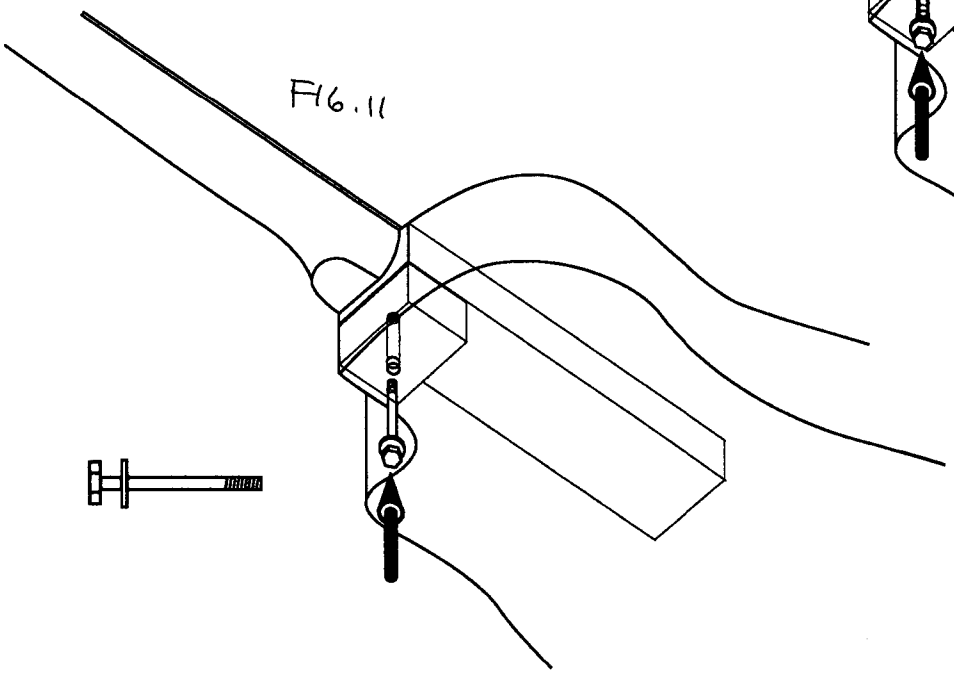

Method of Using the Apparatus:

In one preferred embodiment of the invention, the apparatus has at least two neck assemblies, one body assembly, and a case. The user will insert the first or acoustic neck assembly into the body opening 410 and engage the second end of the first neck assembly into the body (second vibration wing end); once properly positioned, the user can further hold and secure the neck assembly into the modular body by securing a bolt through the body and into the neck (FIG. 8). After the user is finished playing the first or acoustic neck assembly embodiment, the user simply reverses the above steps: release and remove the securing bolt from the body and neck, and slide out the acoustic neck assembly and replace with the second or electric neck assembly (lock the second neck assembly to the modular body). Since the engagement and interface of the body and neck assemblies are uniform and similar, this exchanging of parts should be easy and quick. (See FIG. 14-17).

Also, since both the multiple neck assemblies and a single body can be fit within one instrument case or backpack, transport and storage of this invention should also be easy and quick. (See FIG. 25-29).

Further, another embodiment of this apparatus allows for another flat-style body for attachment to the electric neck assembly, when the acoustic neck assembly is engaged to the modular body assembly. For maximum portability, this flat-style body can be a plate of fiberglass, wood, or other durable material, which should mimic the outline shape of a guitar/bass body. This further increases the usefulness and utility of the invention.

With this invention, the user can have at least two different string instruments in a single modular musical apparatus. Further, since the electric and acoustic neck assemblies are relatively self-contained units, the user does not need to take apart multiple pieces or remove wire or readjust tuning setting. This is a great improvement over the prior art.

In addition, the modular body assembly or body can be substantially hollow, semi-hollow, full-body or small-body. The body is typically a hollow body with an opening to allow the installation of the neck assembly.

This invention further allows for customizing a string instrument neck and body assembly for improving sound, tone, and performance. For example, a semi-hollow body assembly can be engaged with the acoustic neck assembly to achieve the warm sound of an acoustic body with the good performance of a solid body neck. Other combinations are possible, and this invention gives the user a myriad of different ways to play such a wonderful instrument. Because this invention allows for such easy switching of different neck assemblies to a body assembly, such changes are simple and easy.

The "cut-away" style of guitar shape provides the musician with more flexibility for playing solo parts since there is no material in that part of the body that so that the fingers of the musician can go deeper on the neck. In addition, this invention provides for one modular and portable apparatus to be multiple types of guitar, electric and/or acoustic, in one musical instrument assembly. Further, the preferred embodiment's body assembly has a size approximate to that of an acoustic guitar; however, this invention allows for use of different body and neck assembly dimensions to achieve the desired tone, sound, and purpose.

For example, an acoustic guitar neckpiece could be unbolted and pulled out of the body and then an electric guitar neck could be slid in to the body and bolted. As a result, the musician has the ability to change a full-functioning acoustic guitar to a full-functioning electric guitar. This can also be applied to bass string instruments (acoustic and electric) as well and other string instruments; for example, this invention allows changing an electric guitar to an acoustic bass and reverse.

Another embodiment of this invention may allow for a non-string instrument neck assembly to removably engage and interact with the modular body assembly. Such embodiments may include a keyboard, synthesizer, drum machine, or other computing and electronic music devices.

A modular string instrument apparatus comprising: a first string instrument neck assembly, said first string instrument neck assembly having at least one first string instrument neck assembly opening, which passes entirely though the first string instrument neck assembly, at least one first string instrument neck assembly string, at least one first string instrument neck assembly string attachment post, and a first string instrument neck assembly bridge; a second string instrument neck assembly; said second string instrument neck assembly having at least one second string instrument neck assembly string, at least one second string instrument neck assembly string attachment post, an electric string instrument bridge, and at least one electric pickup; a modular body assembly, which is fixedly attached to a vibration resonator, said modular body assembly is substantially hollow, and said modular body assembly being able to removably and separately engage the first and the second string instrument neck assemblies, whereby the user can modify the modular music apparatus by interchangeably attaching and removing the first and the second string instrument neck assemblies to the modular body assembly for particular musical purposes; there are also first and second string instrument neck assemblies each further comprising at least one tuner; the first string instrument neck may further comprise at least one acoustic-type pickup and said modular body apparatus has at least one first modular body surface and at least one second modular body surface; said vibration resonator having a first vibration resonator end and a second vibration resonator end; said first vibration resonator end being fixedly attached to the second modular body surface; and said second vibration resonator end being able to detachably engage the first and the second string instrument neck assemblies; a third musical instrument neck assembly can removably engage said modular body assembly.

A modular string instrument apparatus comprising: at least one string instrument neck assembly; and a modular body assembly being fixedly attached to a vibration resonator, said modular body assembly being substantially hollow and said modular body assembly being able to removably engage the at least one string instrument neck assembly, said modular body apparatus has at least one first modular body surface and at least one second modular body surface; said vibration resonator having a first vibration resonator end and a second vibration resonator end; said first vibration resonator end being fixedly attached to the second modular body surface; and said second vibration resonator end detachably engaging the at least one string instrument neck assembly; whereby the user can modify the modular music apparatus by interchangeably removing and attaching the at least one string instrument neck assembly to the modular body assembly for a particular musical purpose; a first string instrument neck assembly, the first string instrument neck assembly having at least one first string instrument neck assembly opening, which passes entirely though the first string instrument neck assembly; and at least one first string instrument neck assembly string, at least one first string instrument neck assembly string attachment post, and a first string instrument neck assembly bridge; a second string instrument neck assembly; said second string instrument neck assembly having at least one second string instrument neck assembly string, at least one second string instrument neck assembly string attachment post, an electric string instrument bridge, and at least one electric pickup; said modular body assembly being able to removably and separately engage the first and the second string instrument neck assemblies, whereby the user can modify the modular music apparatus by interchangeably attaching and removing the first and the second string instrument neck assemblies to the modular body assembly for a particular musical purpose.

A modular string instrument apparatus comprising: a first string instrument neck assembly, said first string instrument neck assembly having at least one first string instrument neck assembly opening, which passes entirely though the first string instrument neck assembly, at least one first string instrument neck assembly string, at least one first string instrument neck assembly string attachment post, and a first string instrument neck assembly bridge; a second string instrument neck assembly; said second string instrument neck assembly having at least one second string instrument neck assembly string, at least one second string instrument neck assembly string attachment post, an electric string instrument bridge, and at least one electric pickup; a modular body assembly, which is substantially hollow, and said modular body assembly being able to removably and separately engage the first and the second string instrument neck assemblies, whereby the user can modify the modular music apparatus by interchangeably attaching and removing the first and the second string instrument neck assemblies to the modular body assembly for a particular musical purpose; said modular body assembly further comprising at least one first modular body assembly surface, at least one second modular body assembly surface, and a vibration resonator, said vibration resonator having a first vibration resonator end and a second vibration resonator end; said first vibration resonator end being fixedly attached to the second modular body surface; and said second vibration resonator end being able to detachably engage the first and the second string instrument neck assemblies.

While the invention as described above in connection with preferred embodiments, it will be understood that it is not intended to limit the invention to those embodiments. On the contrary, it is intended to cover all alternatives, modifications, and equivalents as may be included within the spirit and scope of the invention as defined by the appended claims. Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

I claim:

1. A modular string instrument apparatus comprising:

at least one string instrument neck assembly;

a modular body assembly;

a vibration resonator;

said modular body assembly being substantially hollow and being able to removably engage the at least one string instrument neck assembly, said modular body assembly has at least one outer modular body surface and a string side and a body side inner modular body surface;

said vibration resonator having a first vibration resonator end and a second vibration resonator end;

said first vibration resonator end being fixedly attached to a non-edge surface on the string side inner modular body surface;

said first vibration resonator end not contacting the body side inner modular body surface; and said second vibration resonator end detachably engaging the at least one string instrument neck assembly;

whereby the user can modify the modular music apparatus by interchangeably removing and attaching the at least one string instrument neck assembly to the modular body assembly for a particular musical purpose.

2. The modular string instrument apparatus of claim 1 further comprising:

a first string instrument neck assembly, the first string instrument neck assembly having at least one first string instrument neck assembly opening, which passes entirely through the first string instrument neck assembly; and at least one first string instrument neck assembly string, at least one first string instrument neck assembly string attachment post, and a first string instrument neck assembly bridge;

a second string instrument neck assembly;

said second string instrument neck assembly having at least one second string instrument neck assembly string;

at least one second string instrument neck assembly string attachment post, an electric string instrument bridge, and at least one electric pickup;

said modular body assembly being able to removably and separately engage the first and the second string instrument neck assemblies, whereby the user can modify the modular music apparatus by interchangeably attaching and removing the first and the second string instrument neck assemblies to the modular body assembly for a particular musical purpose.

3. The modular string instrument apparatus of claim 2, further comprising a case for the first and second string instrument neck assemblies and the modular body assembly.

4. The modular string instrument apparatus of claim 2, said first string instrument neck assembly further comprising at least one acoustic-type pickup.

5. The modular string instrument apparatus of claim 2 further comprising at least one output jack and at least one volume control device and at least one tone control device.

* * * * *